US007146821B2

(12) United States Patent
McKibbin

(10) Patent No.: US 7,146,821 B2
(45) Date of Patent: Dec. 12, 2006

(54) TEMPERATURE-REGULATED STORAGE AND/OR DISPLAY MODULE

(76) Inventor: Terry Trent McKibbin, 8707 W. 86th Ave., Arvada, CO (US) 80005

( * ) Notice: Subject to any disclaimer, the term of this patent is extended or adjusted under 35 U.S.C. 154(b) by 171 days.

(21) Appl. No.: 11/038,866

(22) Filed: Jan. 21, 2005

(65) Prior Publication Data

US 2006/0162360 A1 Jul. 27, 2006

(51) Int. Cl.
*A47F 3/04* (2006.01)

(52) U.S. Cl. ..... 62/246; 62/435

(58) Field of Classification Search ..... 62/246–256, 62/389–400, 430–439
See application file for complete search history.

(56) References Cited

U.S. PATENT DOCUMENTS 5,537,838 A * 7/1996 Mills et al. ..... 62/400

6,185,951 B1 * 2/2001 Lane et al. ..... 62/246

* cited by examiner

*Primary Examiner*—William E. Tapolcai

(57) ABSTRACT

A system that utilizes a rigid support structure of various configurations and materials, with attached item support members designed to hold perishable items to which the module is adapted. A further system of temperature-regulated fluid is employed to flow across the exterior of the support structure upon a free-flow surface in thermal conduction contact with the item support members. The resultant desirable outcome and intention of the system is to thus regulate the temperature of the stored and/or displayed perishable items while simultaneously producing the visual dynamics and potential audible aesthetic qualities of fluid in modified descending motion. The invention lends itself to artistic expressions for design features, within the limits of the claims, while maintaining the technical goals of perishable item preservation, convenience of location within normal living or merchandising space, and display of representative items.

10 Claims, 10 Drawing Sheets

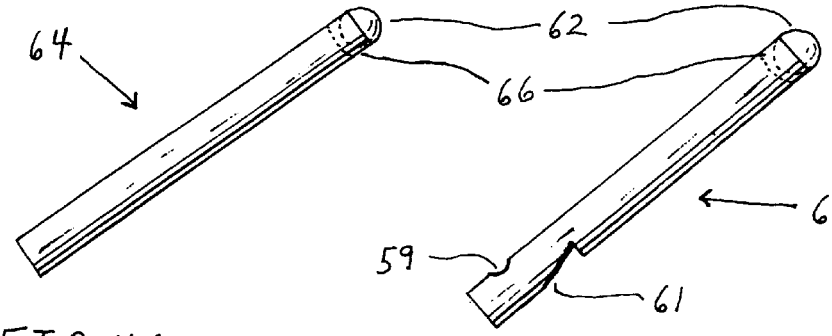
FIG 4A
FIG 4B
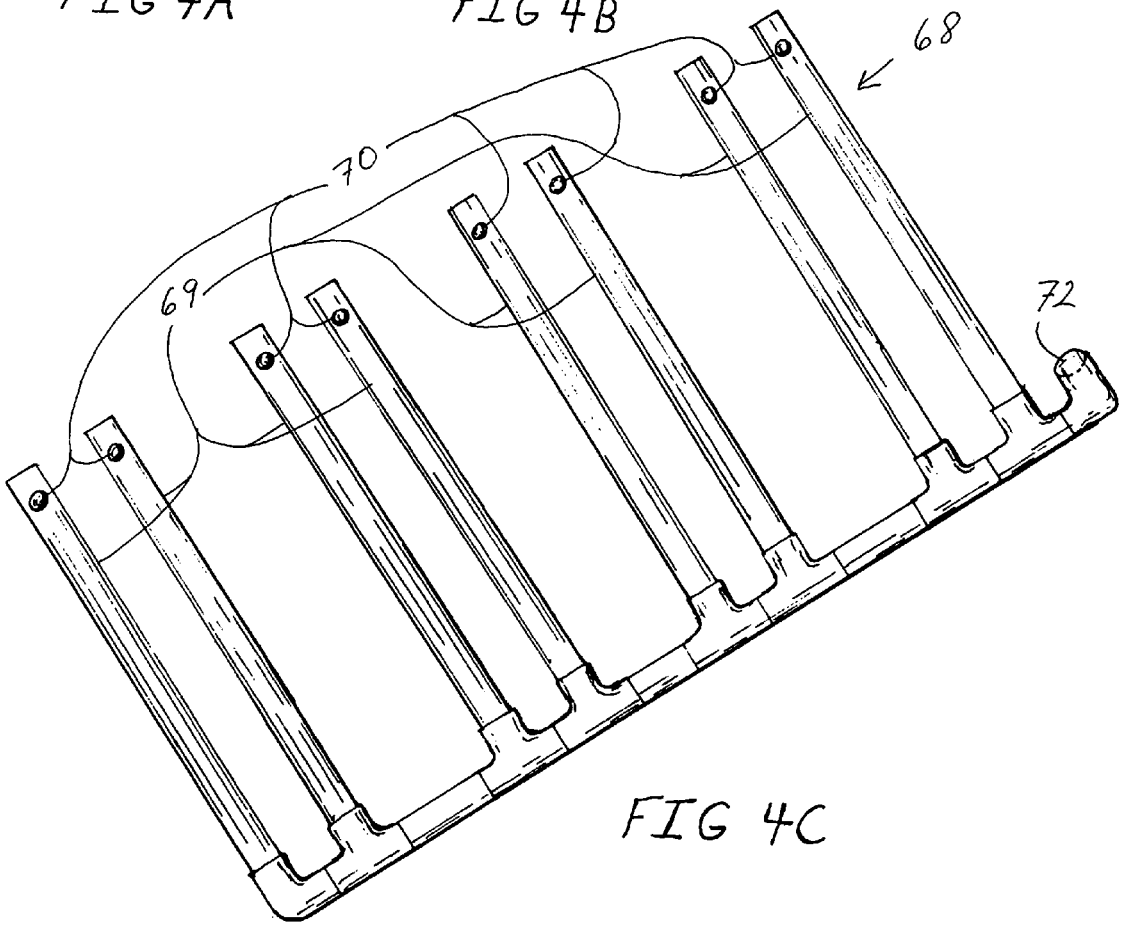
FIG 4C

TEMPERATURE-REGULATED STORAGE AND/OR DISPLAY MODULE

FEDERALLY SPONSORED RESEARCH

Not Applicable

SEQUENCE LISTING OR PROGRAM

Not Applicable

BACKGROUND

1. Field of Invention

This invention relates to the technical and aesthetic storage, preservation, and display of perishable items.

2. Discussion of Prior Art

Historically, the storage, proper preservation, and creative display of perishable and consumable items, such as beverages like wine and beer, have been limited by the technology and creativity applied to the industry. Regarding proper preservation, the maintenance of temperature as well as ambient humidity has long been known to have favorable or deleterious effects upon stored substances, including these bottled beverages. With respect to aesthetic display of consumer items such as bottled beer and wine, it is important to note that the container contours and labels containing images, colors, texture, and text that offer extraordinary human aesthetic appeal, based upon visual recognition and generation of an emotional response, are part of the culture and eventual economics that surround these industries.

Systems for proper, industry-recognized, temperature storage have, for centuries, taken advantage of the ambient earth temperatures found in caves, cellars or various other underground vaults. Various types of racks and crates have been utilized for the organization of the perishable items within the rooms that are somewhat temperature-regulated by the relatively constant ground temperature well below the exposed surface. Generally, this system is inconvenient in that it requires a trip to a space far removed from the general living space of home occupants or storage areas of purveyors in the industry such as wineries or wine stores. Additionally, bottled beverages and other items so stored are not presented in a fashion for public display for the various purposes for which that would be desirable, not the least of which is human interest and the sharing of such interest. That is, the storage system may not be accessible, viewable, or provide for the presentation of the item in an appealing manner, due to dust, cobwebs, poor stairways, insects, or inadequate lighting, or simply the inconvenience of the excursion to a separate space within the building, to name but a few.

In the current era it is most common to find vast quantities of beverages, such as wine, stored and displayed in ambient room conditions. Thus, the accessibility and view ability are often excellent. But, these conditions can, and usually do, include elevated and fluctuating temperatures, both of which are known to be detrimental to the quality of an item such as wine or beer. Some wines, for example, are known to connoisseurs as being more desirable and more economically valuable after several years of proper aging within the container. The process can be impaired to the point of spoilage if, to continue the example, the beverage is subjected to improper conditions, including elevated temperature over a period of time. Thus, most of the non-temperature-regulated shelving and racking systems, simply designed to store and display, fail in their capability to properly preserve and enhance many perishable items.

More modern refrigeration technology has allowed temperature regulation to be utilized in aboveground, ambient room-temperature applications. One current option is a refrigerator box; some having see-through fronts for visual contact with the inner contents without the need for opening the door. Though this option does solve the issue of convenience of access and the proper temperature storage of various perishable items, it offers little with respect to the aesthetic display of containers, labels or contents. The boxes have few aesthetically appealing creative characteristics from their own intrinsic appearance or sound and do little to show-off those aspects of the item that appeal to the consumer. In some ways, this approach is thought to have removed an element of "charm" that was associated with the stone walls of caves or the arched ceilings of other underground storage systems with the possible sounds of trickling water in these underground areas. Stores have indeed adopted open-faced refrigerated display cases that allow ease of visual contact with some types of perishable items such as produce and cheeses. Still, there is a general lack of aesthetic appeal to the storage system itself, leaving the marketing of the product solely to the manufacturer of that product and offering little to augment or present the product in a more titillating and aesthetic fashion.

With this "charm" and the notions of proper storage and preservation in mind, a modern approach has been taken to recreate the storage cellar by building an entire room within a larger living or commercial space that is temperature and humidity regulated to best suit the needs of the perishable item. The temperatures so desired, commonly between fifty-five and sixty degrees Fahrenheit for wines, for example, are great for the stored item but uncomfortable for most humans over any extended period. Thus, the room is generally isolated by walls from the more inhabitable areas of the human-occupied spaces. Additionally, to adequately isolate this space from the other warmer, less humidified spaces requires a significant expenditure of resources for special construction and maintenance.

Furthermore, many racking and shelving systems do not properly position corked beverage bottles. The constant contact of bottle contents with a cork closure is essential for prevention of cork shrinkage. In turn, this prevents exchange of outside air and evaporated fluid from within. It is this process that causes one type of premature breakdown of beverage quality. Secondly, the improper positioning of bottles of some beverages prevents the settling of sediments to the lower portion of the bottle where, in the case of wine bottles, a trough is designed into the bottle for the collection of such sediments.

Space utilization is another area of concern where many items are being stored. Some storage systems stack items for maximum use of space. Items in the lower portions of the system cannot be removed without the difficulty and disturbance of removing items resting upon them. Other systems use so much shelving material that the total consumption of space is, unfortunately, utilized by the shelving rather than the desired product that it was designed to store and display. Various compact systems do not provide for the visual inspection of a representative item and its label without the removal of an item from the system. This then introduces the possibility of breakage and limits the inspection of many alternative choices within a given period of time.

There has been a veritable explosion of creative designs surrounding the display and storage of bottled beverages such as wine. The remarkable creativity, however, is hampered by the inability of the designs to include ample storage capacity or the capability of proper conditions for preservation of perishable substances.

The use of fluid dynamics for the purpose of combining the capability of thermal regulation and aesthetic presentation is lacking in the prior art. A category of creative systems that utilizes the aesthetic qualities, but not the storage and display capabilities exists within the framework of waterfalls, water fountains, water sculpture, fountain furniture, etc. None of these available, that could be found, combines the creative water features with the practical notion of storage, preservation, and display of perishable items.

The most directly relevant items of manufacture in the public domain that could be found are the display cases designed to maintain the humidity of stored and displayed produce such as lettuce or carrots. These systems are generally equipped with shelving and spray nozzles for showering the shelf-displayed produce with a mist of water on some intermittent frequency. They have even incorporated sounds of nature, like thunder, to give warning to those in proximity that the impending "rains" are soon to begin. What these systems have not attained, nor in my estimation even attempted, is to utilize the practical elements and procedures in a manner that is an aesthetic feature. In other words, the water spray has a practical purpose and the structure that is associated does not utilize the movement of water across a surface for the production of natural flowing water aesthetics as is found in the above mentioned waterfalls and water fountains. Put bluntly, this prior art does not exhibit the engineered or innate capability of naturally producing the visual and audio aesthetic qualities of ambient-exposed, modified falling water in combination with its storage and display capabilities. A further shortcoming of this storage mechanism is the necessity of direct contact of the water with the stored items to accomplish the objective of humidity and/or temperature regulation. Many perishable items do not preserve well with direct contact of aqueous media. Additionally, intricate labeling and advertising means such as paper labels do not generally react favorably to direct contact with fluids. There are, apparently, no systems that allow indirect physical contact with a substantially direct thermal contact with stored items of a visibly dynamic fluid flowing in a manner that offers some aesthetic attraction. The inventor believes such a module would offer significant advantages in many cases.

OBJECTS AND ADVANTAGES

Accordingly, the objects and advantages of this invention arise from the successful combination of the attributes that other systems have not succeeded in assembling together. They are:

(a) to regulate temperature of the stored object or substance, and (b) to provide humidity enhancement in the region of the stored material, and (c) to offer the convenience of locating the storage device within habitable ambient room conditions, and (d) to provide a highly accessible and viewable product, and (e) to allow for an excellent display of a representative item while maintaining proper storage conditions for that item, and (f) to avail for the utilization of raw and naturally appealing elements for construction such as wood, copper, glass, stone, or other options to add natural and charming appeal, and (g) to create visual interest using cascading fluid motion and the associated intrinsic reflective, refractive, and diffractive light behavior, and (h) to provide an option of the natural sound of cascading water for aesthetic interest, and (j) to give versatility by providing for the proper and/or creative arrangement of stored items—example: proper angle for the storage of corked beverage bottles, including the display bottles, and (k) to make easy the removal of any particular stored item, and (l) to offer flexibility for a variety of storage designs for space utilization—example: organizable and customizable to "case' quantities such as twelve, and (m) to provide variable flow regulation to the viewable fluid free-flow surface for changing the affect of the fluid, and (n) to engineer for an endless variety of potential artistic designs and enhancements to the invention, and (o) to provide for temperature regulation and humidity enhancement of a stored item without direct contact with a fluid media.

The described objects and advantages do not define a particular shape, size, or configuration, but will be represented in this document by one example that has been built and tested. Other representations will be suggested in order to demonstrate configuration and design options based upon the same objects and advantages. These options are adapted to other specific uses and/or exhibiting other aesthetic expressions.

Other objects and advantages will become apparent from the specification and drawings.

SUMMARY

The invention is a temperature-regulated storage and/or display module of various shapes, sizes and configurations for the storage, preservation and display of perishable items. It has the essential inventive elements of a support structure capable of housing a conduit for transporting temperature-regulated fluid through a course that includes thermal contact with item support members such as rods or other holders that are supported by the rigid support structure. The item support members are capable of transporting heat such that the items of interest will be temperature-regulated without direct contact with the fluid. The presented embodiment takes advantage of modern refrigeration with the utilization of a chiller, but differs from refrigerated cases and boxes in that a temperature-regulated fluid is allowed to flow external to the support structure to create visible and audible affects for aesthetic purposes.

The temperature-regulated storage and/or display module, is represented in the main embodiment presented, housed within a wood cabinet (see FIG. 7) that supports a rectangular configuration of the module. The configuration includes a racking arrangement designed specifically for most common 750 milliliter wine bottles. The organization of the rack is such that four cases, of twelve bottles each, can be stored conveniently. Each case occupies two vertical columns. Each of the four cases is provided a display rack where the bottle label can be easily read without removing the bottle. There are four additional spaces for random bottles not necessarily associated with the four cases of twelve. Two copper rods securely cradle each bottle.

Removal of any of the bottles does not disturb those remaining. Other embodiments of the invention are represented in FIGS. 8 and 9, having all of the elements of the main, independent claims.

DRAWINGS

Drawing Figures

In the drawings, closely related figures have the same number but different alphabetic suffixes.

FIGS. 4A to 4C show different types of item support members (ISMs) utilized in this particular rendition of the invention. FIG. 4A shows a standard ISM (SISM), FIG. 4B a ported ISM (PISM), and FIG. 4C a manifold ISM (MISM).

Figure 1A:
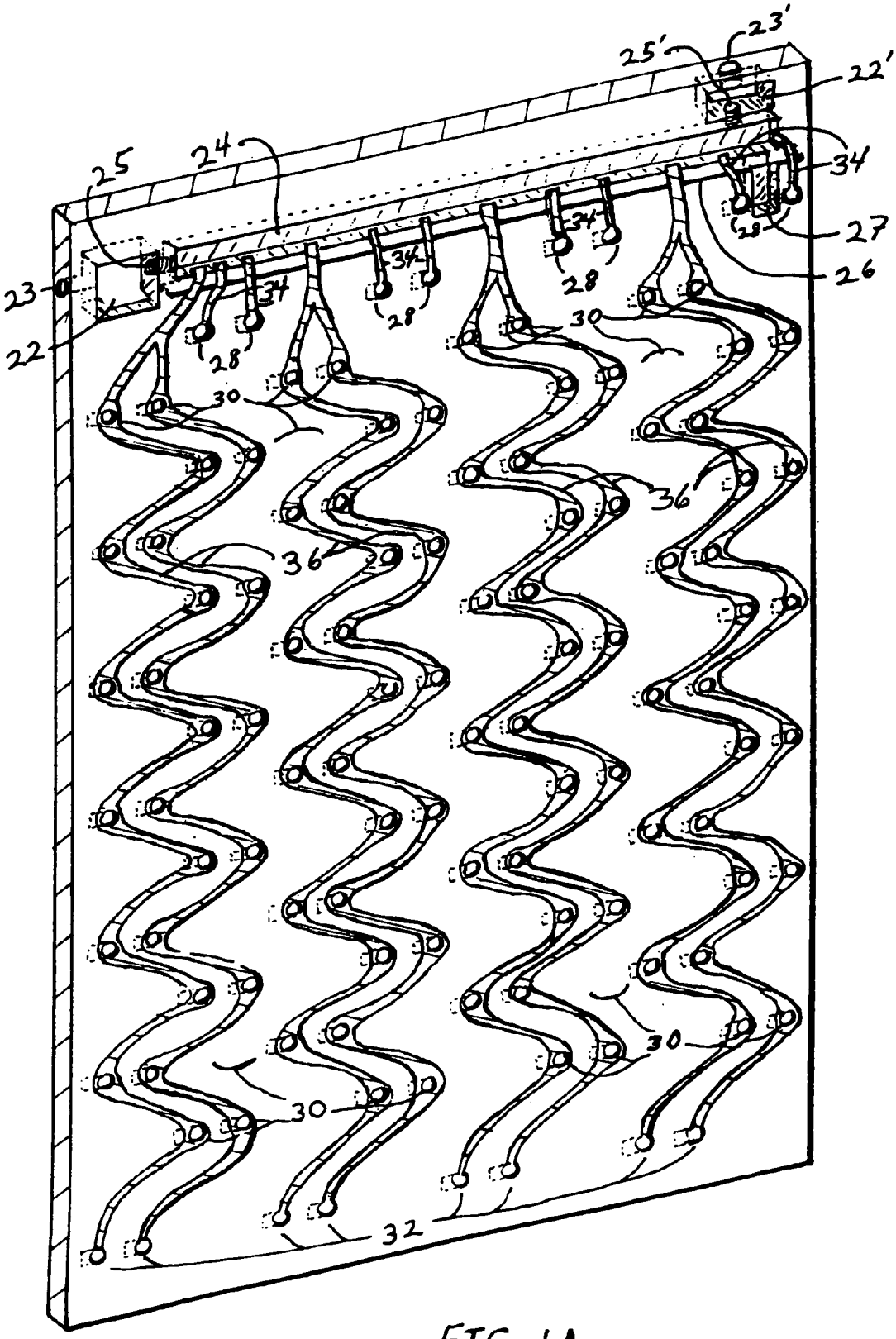
FIG. 1A shows a face perspective view of a basic form of a rigid support structure (RSS). The figure shows milled holes, grooves, slots, cutouts and other millings in the RSS.

REFERENCE NUMERALS IN DRAWINGS 20 rigid support structure (RSS)
22 and 22'cutouts for tubing fittings
23 and 23'access holes
24 incoming-fluid manifold slot
25 and 25' incoming-fluid manifold fitting ports
26 sliding gated-valve groove
27 gated-valve handle byway
28 ported item support member (PISM) holes
30 standard item support member (SISM) holes
32 manifold item support member (MISM) holes
34 PISM channels
36 SISM to MISM channels
37 rigid support structure (RSS) cover
38 sliding gated-valve handle cutout
40 ISM RSS cover holes
45 and 45' fluid-supply conduit channels
46 L-shaped, threaded tubing fitting
47 L-shaped tubing fitting
48 fluid-supply conduit
49 plastic tubing
50 splitter tubing fitting
52 sliding gated-valve bar
53 PISM cutout notches
54 SISM to MISM cutout notches
56 gated-valve lever
58 stainless steel screw
59 holes in PISM tubes
60 ported item support member (PISM)

-continued

61 PISM port
62 glass sphere
64 standard item support member (SISM)
66 foamed-plastic plug
68 manifold item support member (MISM)
69 copper manifold tubes
70 holes in base of MISM
72 MISM outlet port
73 free-flow surface (FFS)
74 back copper sheeting
76 base copper sheeting
77 hole for drain assembly
78 ISM holes
84 common sink drain assembly
86 rigid support structure
88 item support members
90 fluid conduit
92 free-flow surface

DETAILED DESCRIPTION

Figure 1B:
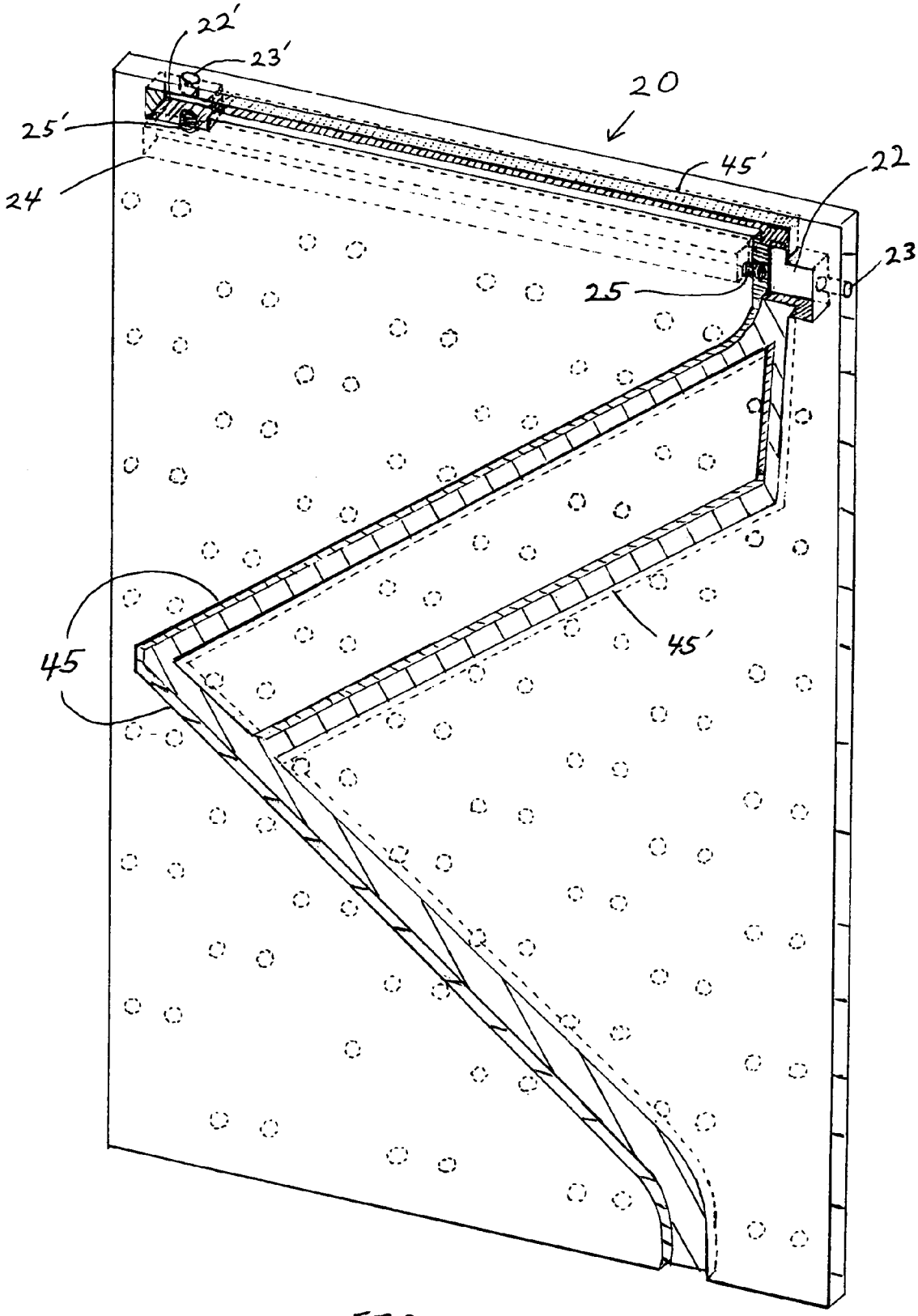
FIG. 1B is a backside perspective drawing of the RSS showing channels, ports for fittings, and cutouts for housing a fluid-supply-conduit.
Figure 1C:
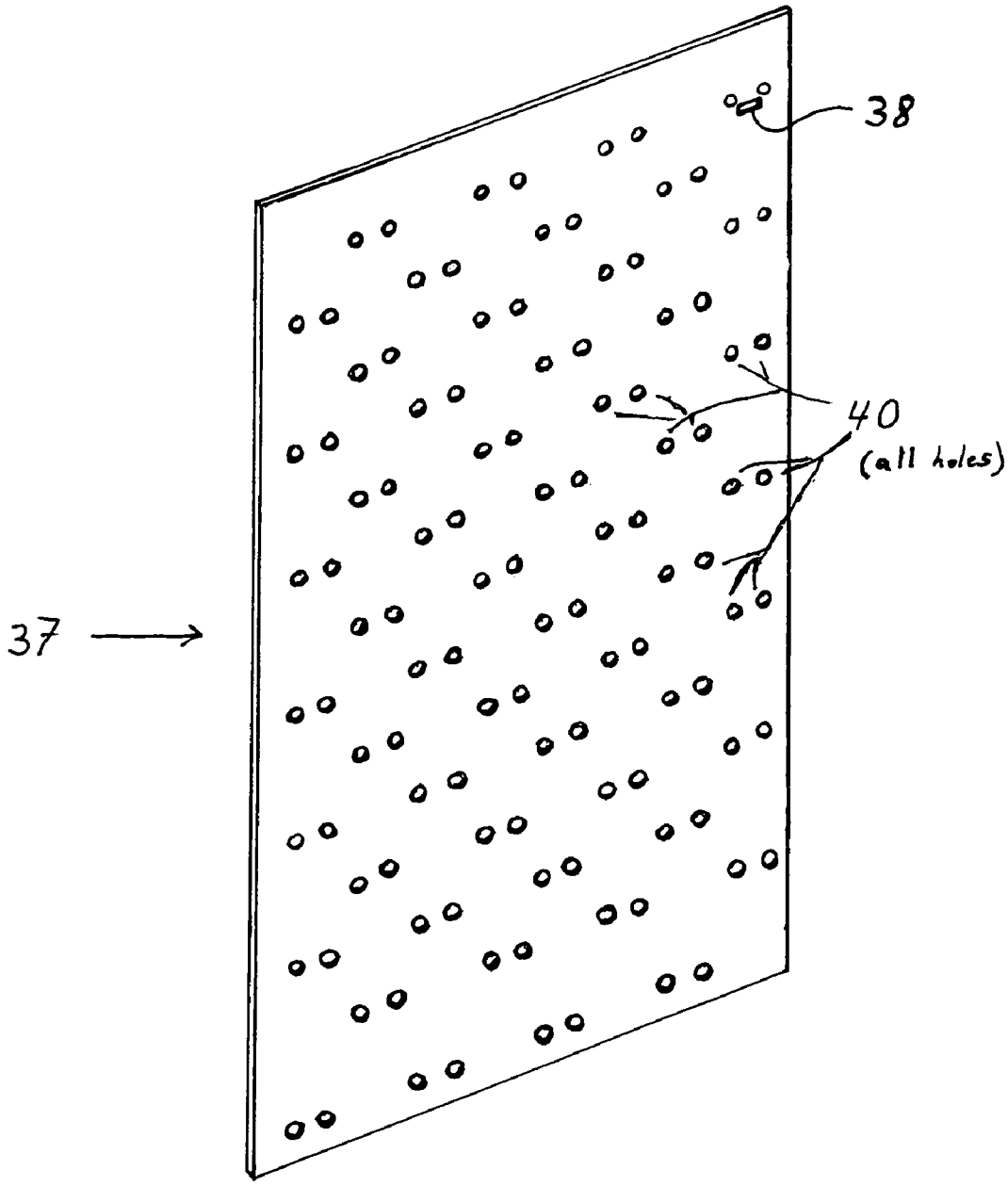
FIG. 1C shows the RSS cover that seals the interior flow channels.

Description—FIGS. 1A and 1C

FIG. 1A shows a front perspective view of a rigid support structure (RSS) 20 for a basic version of the module. In this version, or embodiment, RSS 20 is a 61 cm×91.5 cm×2.5 cm piece of high density polyethylene (HDPE). RSS cover 37, in FIG. 1C, is a thinner sheet of HDPE measuring 61 cm wide×91.5 cm long×4.76 mm thick.

Cutouts

There are two cutouts 22 and 22', both 4 cm×7.5 cm making space for L-shaped threaded tubing fittings 46 at each top corner of RSS 20. Top left cutout 22 is located 3.5 cm from each edge RSS 20. Top right cutout 22' is located 2.5 cm from the right edge and 0.5 cm from the top of the RSS. Both cutouts remove the entire section of the RSS.

Another cutout, a sliding gated-valve handle cutout 38, is positioned on RSS cover 37 beginning 4.5 cm from the right edge of RSS cover 37. Cutout 38 is 1.8 cm from right to left and 1.0 cm from top to bottom beginning at 10.8 cm from the top edge of RSS cover 37.

Slot

An incoming-fluid manifold slot 24 is milled to a depth of 2.5 cm×1.5 cm wide×48 cm in length. Manifold slot 24 is located parallel with the top edge of RSS 20 with slot 24 beginning 6.0 cm from the top edge and 2.0 cm from the right edge of the RSS.

Groove and Byway

A sliding gated-valve groove 26 is milled to a depth of 1.9 cm×3.18 cm wide from top to bottom of RSS 20×48 cm in length from right to left on the RSS. Groove 26 is located parallel with the top edge of the RSS with groove 26 beginning 8.5 cm from the top edge and 2.0 cm from the right edge of RSS 20.

A gated-valve handle byway 27 is milled to connect with groove 26. The byway is positioned to begin from right to left, 4.3 cm from the right edge of RSS 20 and is 2.0 cm wide from right to left×3.2 cm long from the bottom edge of groove 26 downward at a depth of 1.6 cm.

Holes

A top horizontal row of holes across the face plane of RSS 20, PISM holes 28, begin with the right-most hole centered at 3.6 cm from the right edge and 10 cm from the top edge of RSS 20. PISM holes 28 alternate distances between hole-centers beginning with 3.5 cm, then 10.6 cm, to include a total of 8 PISM holes 28. The PISM holes are parallel with top edge of RSS 20. The PISM holes are 1.5875 cm in diameter and are drilled to a depth of 1.9 cm at the deepest point, angled at 100° from a downward vector line that is parallel with the surface plane and parallel with the side edges of RSS 20. Thus, PISM holes 28 will be at an angle 10° greater than perpendicular to the RSS when it is in the upright, vertical operating position as shown in FIG. 6 and FIG. 7. A second horizontal row of holes, the first of 12 rows of SISM holes 30, begins across the face plane of RSS 20 with the right-most hole centered at 10.6 cm from the right edge and 5.3 cm from horizontal line established by the center of PISM holes 28. SISM holes 30 alternate distances between hole-centers beginning with 3.5 cm then 10.6 cm to include a total of 8 SISM holes 28 across the second horizontal row. The SISM holes are parallel with the top edge of RSS 20. SISM holes 30 are drilled to a depth of 1.9 cm at the deepest point and are angled at 100° from a downward vector that is parallel with the surface plane and parallel with the side edges of the RSS 20. Thus, SISM holes 30 will be at an angle 10° greater than perpendicular to the RSS when it is in the upright, vertical operating position as in FIG. 6 and FIG. 7. A $3^{rd}$ horizontal row of holes, the $2^{nd}$ row of SISM holes 30, begins with the right-most hole centered at 3.6 cm from the right edge and 5.3 cm from the horizontal line established by the center of the $1^{st}$ row of SISM holes 30. This row of SISM holes alternate distances between hole-centers beginning with 3.5 cm then 10.6 cm to include a total of 8 SISM holes 28 across the $3^{rd}$ total, horizontal row of holes. SISM holes 30 are parallel with the top edge of RSS 20. SISM holes 30 are drilled to a depth of 1.9 cm at the deepest point and are angled at 100° from a downward vector that is parallel with the surface plane and parallel with the side edges of RSS 20. The pattern of alternating start positions for the $1^{st}$ hole in the subsequent horizontal rows of the SISM holes is repeated until there is a total of 12 rows of SISM holes 30 in the face of RSS 20. All SISM holes are 1.5875 cm in diameter at a depth of 1.9 cm, and all at the aforementioned angle of 100°. A final, $14^{th}$ total, horizontal row of holes is a $1^{st}$ row of MISM holes 32. MISM holes 32 begin with the right-most hole centered at 10.6 cm from the right edge of RSS 20 and 8.5 cm from the horizontal line established by the centers of the last, or $12^{th}$, row of SISM holes 30. MISM holes 32 alternate distances between hole-centers beginning with 3.5 cm then 10.6 cm to include a total of 8 SISM holes 32 across the $14^{th}$ total, horizontal row of holes. The MISM holes are drilled at a diameter of 1.5875 cm to a depth of 1.9 cm at the deepest point and are angled at 80° from a downward vector that is parallel with the surface plane and parallel with the side edges of the RSS 20.

A second set of ISM holes 28, 30, 32 matching the pattern of holes in RSS 20 are drilled completely through RSS cover 37.

There are two access holes 23 and 23' drilled through the edges of RSS 20 into the cutouts 22 and 22'. These access holes are positioned to access the center of their respective cutouts 22 and 22' from the left edge and the top edge of RSS 20, respectively. The diameter of each access hole 23 and 23' is 1.9 cm.

Ports

Incoming-fluid manifold fitting ports 25 and 25' are drilled and tapped through RSS 20 at the left end and the right top of incoming-fluid manifold 24. A 15 mm hole is drilled through the HDPE material separating cutouts 22 and 22' from manifold 24. Access holes 23 and 23' are utilized to center ports 25 and 25' with the bores of the holes parallel to the face plane of RSS 20. The ports are then tapped with a standard 1.5875 mm (⅝ inch) pipe thread tap. L-shaped, threaded tubing fittings 46 are screwed into position in each of the ports. Once seated firmly, fitting 46 in port 25 is directed downward whereas fitting 46 in port 25' is directed to the left toward cutout 22.

Channels

There are two distinct sets of channels milled into the face of RSS 20. A set of PISM channels 34, having dimensions of 6.35 mm×6.35 mm, are milled directly from the bottom of incoming-fluid manifold slot 24 to the top center of each of PISM holes 28. The two right-side PISM holes will have byway 27 located between them. The two PISM channels associated with these holes should clearly avoid contact with byway 27 by angling the channels slightly to maintain at least 3 mm of HDPE material between the two right-most channels and the byway.

A second distinct set of channels, SISM to MISM channels 36 also originate from the lower boundary of incoming-fluid manifold slot 24. These channels should be milled after the channels on the backside of the RSS 20 shown in FIG. 2. SISM to MISM channels 36 are milled to a depth of 6.35 mm and originate as 4 distinct channels of 12.7 mm wide beginning from slot 24 directly above each paired set of $1^{st}$ row SISM holes 30. Approximately 4 cm above $1^{st}$ row of SISM holes 30, each channel 36 splits into two distinct channels of 6.35 mm deep×6.35 mm wide. In essence, 8 channels 36 then proceed in a downward zigzag fashion intersecting through each SISM hole 30, ending at each MISM hole 32 as shown in FIG. 1A. Channels 36 are milled around both sides of each SISM hole 30 such that there is not HDPE material of RSS 20 between the channels and the holes. Channels 36 terminate and intersect with MISM holes 32. No additional milling is performed around the MISM holes.

Screw Holes and Taps

Screw holes of diameter 7 mm are drilled through RSS cover 37 at the following coordinates measured from top and left. The units are centimeters.

| | T | | | | | | | | | | | |
|---|---|---|---|---|---|---|---|---|---|---|---|---|
| | 4.5 | 4.5 | 4.5 | 5.0 | 46 | 87 | 5 | 46 | 87 | 25 | 43 | 58 |
| L | 12 | 31 | 49 | 1.0 | 1.0 | 1.0 | 60 | 60 | 60 | 27 | 34 | 27 |

Holes are countersunk such that a bevel head 6.35 mm (¼ inches)×2.54 cm (1 inch) nylon screw, having 20 threads per inch, will be flush with the surface of RSS cover 37 when fully inserted.

Screw pilot holes are drilled in the same corresponding locations of RSS 20 with a #7 drill bit to a depth of 2.2 cm. Screw pilot holes are then tapped with a 6.35 mm (¼ inch) 20 thread per inch tap.

Adhesive Transfer Tape

An adhesive transfer tape is applied to the perimeter of RSS 20, inside of cutouts 22 and 22'. The adhesive utilized is 3M™ 300 LSE, one inch wide.

Figure 2:
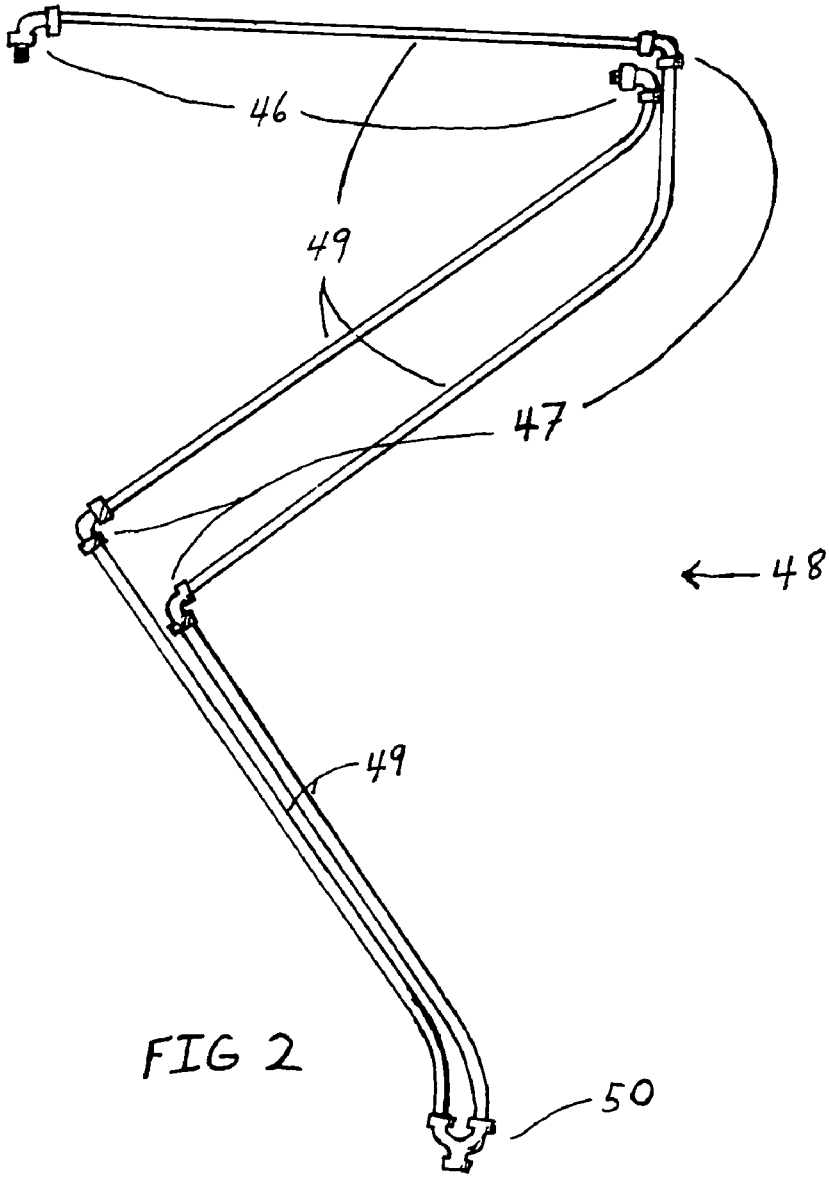
FIG. 2 is the configuration of the fluid-supply-conduit.

Description—FIG. 1B and FIG. 2

FIG. 1B is a back perspective drawing of RSS 20. Generally, the back of the RSS is channeled and houses an incoming-fluid-supply-conduit 48. FIG. 2 shows the conduit.

Channels and Incoming-Fluid Conduit

A set of fluid-supply-conduit channels 45 and 45' are milled from the backside of RSS 20 at a depth of 1.6 cm. The location of channels 45 and 45' are best drawn on the back of RSS 20 by first locating the position of the holes coming from the front side. This can be accomplished most easily by using a light source on the front side that will illuminate the hole-regions on the backside. Draw the channels in an angle between holes as indicated in FIG. 2. The width of the channels is enough to accommodate a pair of 1.27 cm (½ inches) o.d. plastic tubes 49 and 49' (FIG. 2), or approximately 3.0–3.5 cm. Measuring from the bottom, back, right edge of the RSS, the channel is milled between 4 cm and 10 cm for a length of approximately 5 cm to accommodate a splitter tubing fitting 50. Fitting 50 is a 1.27 cm (½ inch) push-in splitter that has been drilled out on the single-input side to a diameter of 15 mm. It remains 1.27 cm (½ inch) push-in for both output holes of the fitting. Tubes 49 and 49' are routed side by side in a single channel for approximately 57 cm at which point the right-most tube 49' is routed along the intersecting diagonal space created within the pattern of holes 30 leading toward cutout 22. The other of the paired tubes continues until intersecting the next highest diagonal path leading to the same cutout. At each of the turning points for tubes 49 and 49', an L-shaped push-in type tubing fitting 47 is utilized to make the direction change. Each of these fittings is shaved or filed so that the dimension of the fittings parallel to the face plane of RSS 20 is 1.9 cm. At the exact location of fittings 47 the HDPE material of RSS 20 is milled to a total depth of 1.9 cm. This area is then outlined with black marker at the outer-most barrier of the 1.9 cm cuts. Then, on the front side of the RSS, marks are made corresponding to those on the back by visualizing the dark line projected through the remaining HDPE material. Aforementioned SISM to MISM channels 36 that cross these areas are milled to a total depth of 4.5 mm rather than the 6.35 for the remainder of channels 36.

Once fluid-supply-conduit channels 45 are parted from one another the width is reduced to 1.5 cm. Lower right-most channel 45' proceeds to curve after passing the right-most hole of the third horizontal row of holes 30 viewing from the backside of RSS 20. The curving channel 45' transitions such that it smoothly goes to a vertical line of travel passing directly between the final two holes of the second horizontal row viewed from the backside of RSS 20. Channel 45' continues its vertical course through cutout 22 to within 2 cm of the top of RSS 20. Space is milled to a depth of 1.9 cm to accommodate a third shaved or filed, L-shaped push-in type tubing fitting 47 directed toward cutout 22'. Finally, channel 45' takes a course parallel with the top edge of RSS 20 to intersect with cutout 22' such that tubing 49' aligns with fitting 46 in port 25'. Channel 45 curves gently, avoiding any holes 30, to transition smoothly as it approaches to within several centimeters of cutout 22 such that tubing 49 aligns with fitting 46 in port 25. The tubing is cut to proper lengths between fittings and the entire fluid-supply-conduit is assembled and secured into the channels with duct tape.

Figure 3:
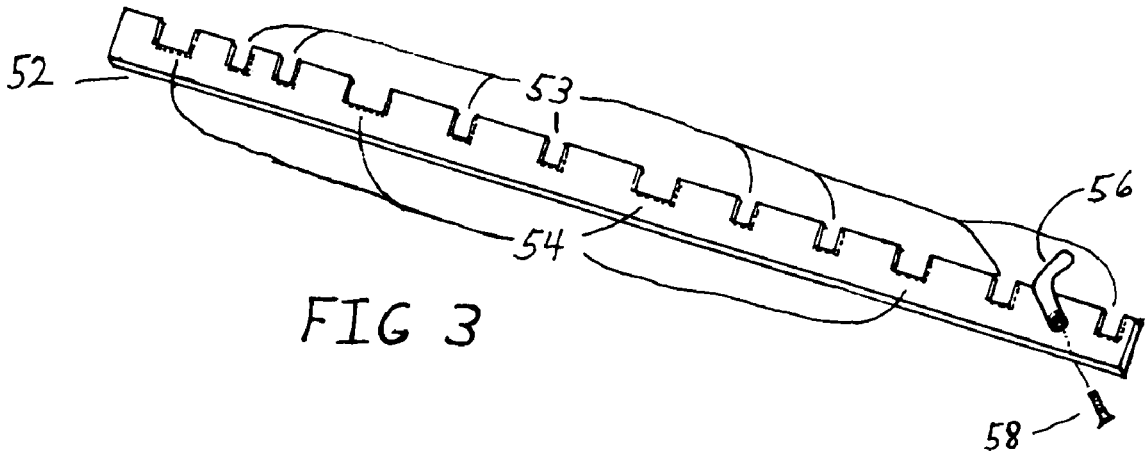
FIG. 3 shows a gated sliding valve with a handle and cut notches.

Description—FIG. 3

FIG. 3 is a perspective drawing of a sliding gated-valve bar 52. Beginning with an aluminum bar 3.175 mm thick× 1.9 cm wide×46 cm long, the bar is positioned into sliding gated-valve groove 26 as far to the right as allowed. Then, eight PISM cutout notches 53 are made to correspond with the width and depth of PISM channels 34 with bar 52 in this position. An L-shaped brass rod with a female threaded screw hole in one end makes gated-valve lever 56. The lever is attached to the bar with a stainless steel machine screw 58. The lever is located such that its right side is against the right side of sliding gated-valve handle cutout 38 while bar 52 is in the far-right position. With the bar positioned to the far left, four SISM to MISM cutout notches 54 are made in bar 52 to align with SISM to MISM channels 36. The bar is polished of all burrs and sharp edges, greased with high quality waterproof grease, and placed into the sliding gated-valve groove.

Joining of RSS and RSS Cover

RSS cover 37 is placed on the face of RSS 20 aligning all holes. Bevel headed, 6.35 mm (¼ inches)×2.54 cm (1 inch) nylon screws, having 20 threads per inch, are inserted through the screw holes and tightened.

Description—FIG. 4

FIGS. 4 A–C are perspective drawings of the various types of item support members (ISMs) utilized in this embodiment. All of the ISMs in this embodiment are constructed of 1.27 cm (½ inch) I.D. copper tubing.

FIG. 4A shows a standard item support member (SISM) 64 and FIG. 4B a ported item support member (PISM) 60, both square-cut on both ends to a length of 18.5 cm. In one end a 14 mm glass sphere 62 is forced into the opening and seated approximately halfway into the end of the tubing. From the other end, polyurethane glue is dropped in to fall and contact the marble and the tubing held in a down position. A foamed plastic plug 66 is forced into the open end to contact the glue and marble.

PISM 60 in FIG. 4A has a PISM port 61 formed by making a square cut across approximately one-third of the diameter of the tube at 3 cm from the open end. The short end of the PISM tubing, at the cut, is creased inward to form the PISM port. At the base of each PISM tube 60, on the opposite side of the tube from port 61, a 7 mm hole is drilled to correspond with each PISM channel 34 entering each PISM hole 28.

FIG. 4C shows a manifold item support member (MISM) 68. The MISM is constructed of eight copper manifold tubes 69 square-cut to lengths of 36 cm. The individual tubes are joined at one end by a combination of standard copper L-fittings and T-fittings as shown in FIG. 4C. The distance between tubes corresponds to the distance between MISM holes 32. At the base of each manifold tube 69, a 7 mm hole, MISM hole 70, is drilled to correspond with each SISM to MISM channel 36 entering the MISM holes. At the right outer corner of the MISM an open-ended copper L-fitting, forming a MISM outlet port 72, angles back toward the open end of MISM 68.

Figure 5:
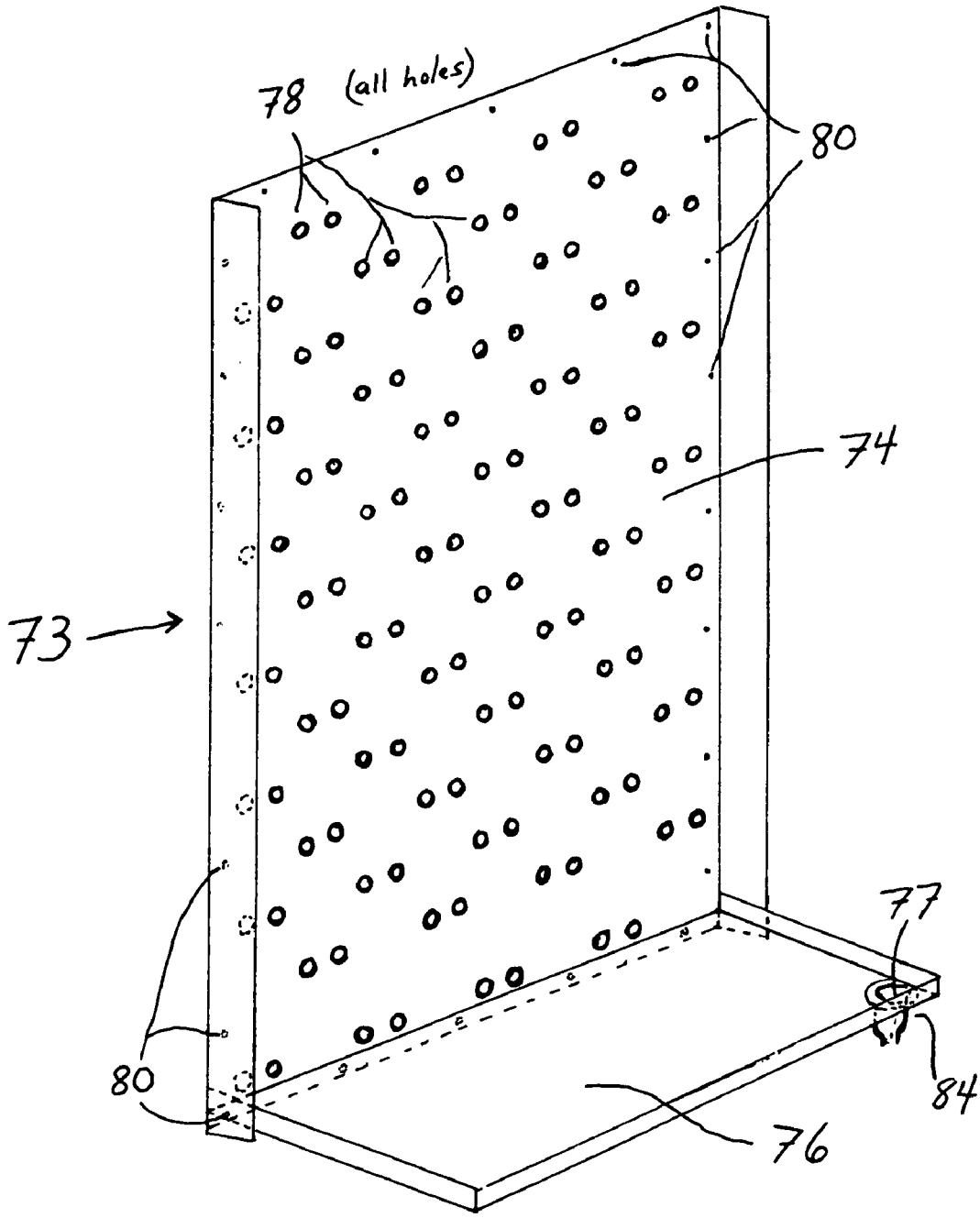
FIG. 5 shows a free-flow surface (FFS) with a back and basin portion with a sink drain assembly in the basin.

Description—FIG. 5

FIG. 5 shows a perspective drawing of a free-flow surface (FFS) 73. In this embodiment of the module, the FFS is built from 16 gauge copper sheet metal. It is comprised of two distinct parts including a back copper sheeting 74 and a base copper sheeting 76. The back sheet has holes made in the same size and pattern as those in RSS cover 37. The size of the back sheet is 75 cm across and 91.5 cm long. The sides are bent forward at a 90° angle along lines 7.5 cm from each edge. Base sheet 76 is 66 cm wide×40 cm long. The sides and front are bent upward (assuming the finished orientation) at 90° along lines 3 cm from each of the three corresponding edges and are solder joined and sealed at the corners. Base sheet 76 has a 90° downward bend along a line 2 cm from the corresponding edge. The folded-down back of base sheet 76 is soldered in position against back sheet 74 along a line beginning at 4 cm above the right bottom edge to 3 cm above the left bottom edge of the back sheet. All seams where copper sheets 74 and 76 meet are solder joined and sealed. A hole 77 is drilled to accommodate a common sink drain assembly 84 in the outer corner, corresponding to the same side as outlet port 72 of the MISM, of the base sheet of free-flow surface 73.

Figure 6A:
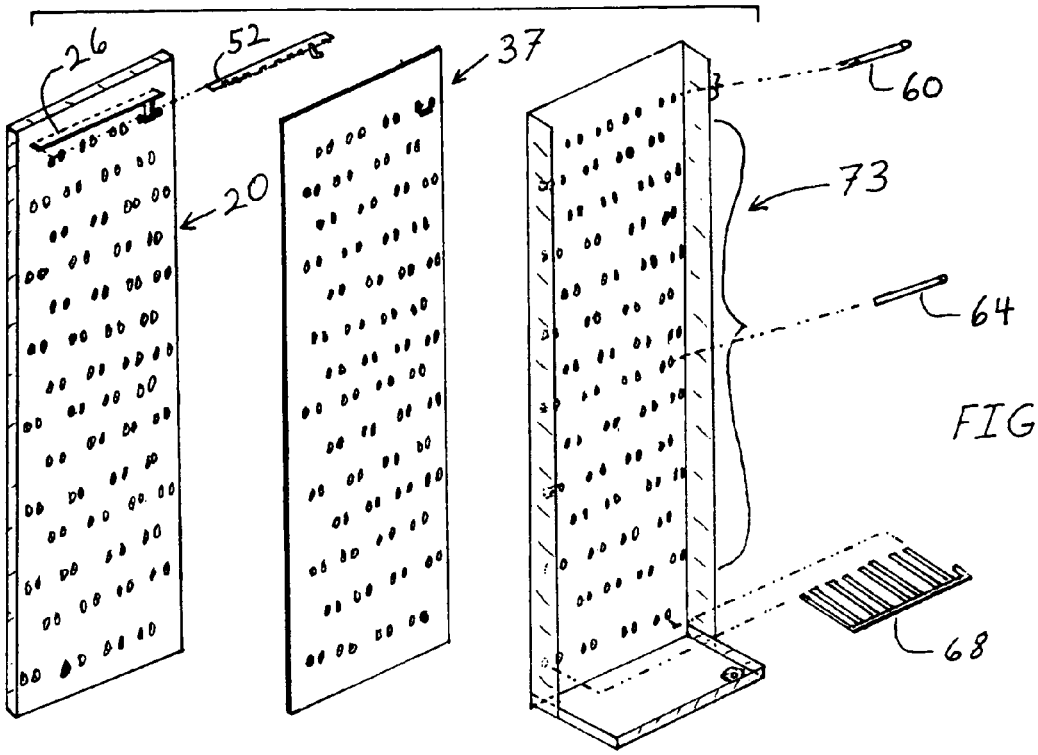
FIGS. 6A and 6B show the assembly of the preferred embodiment of the module.
Figure 6B:
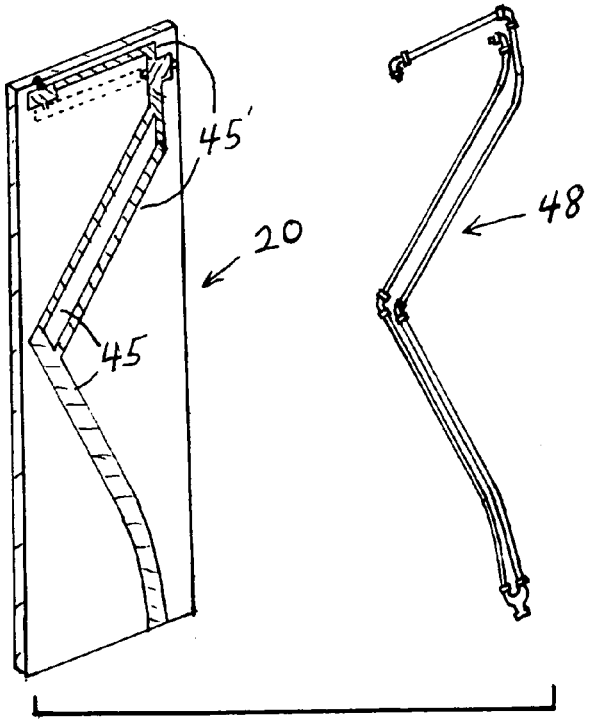
Figure 7:
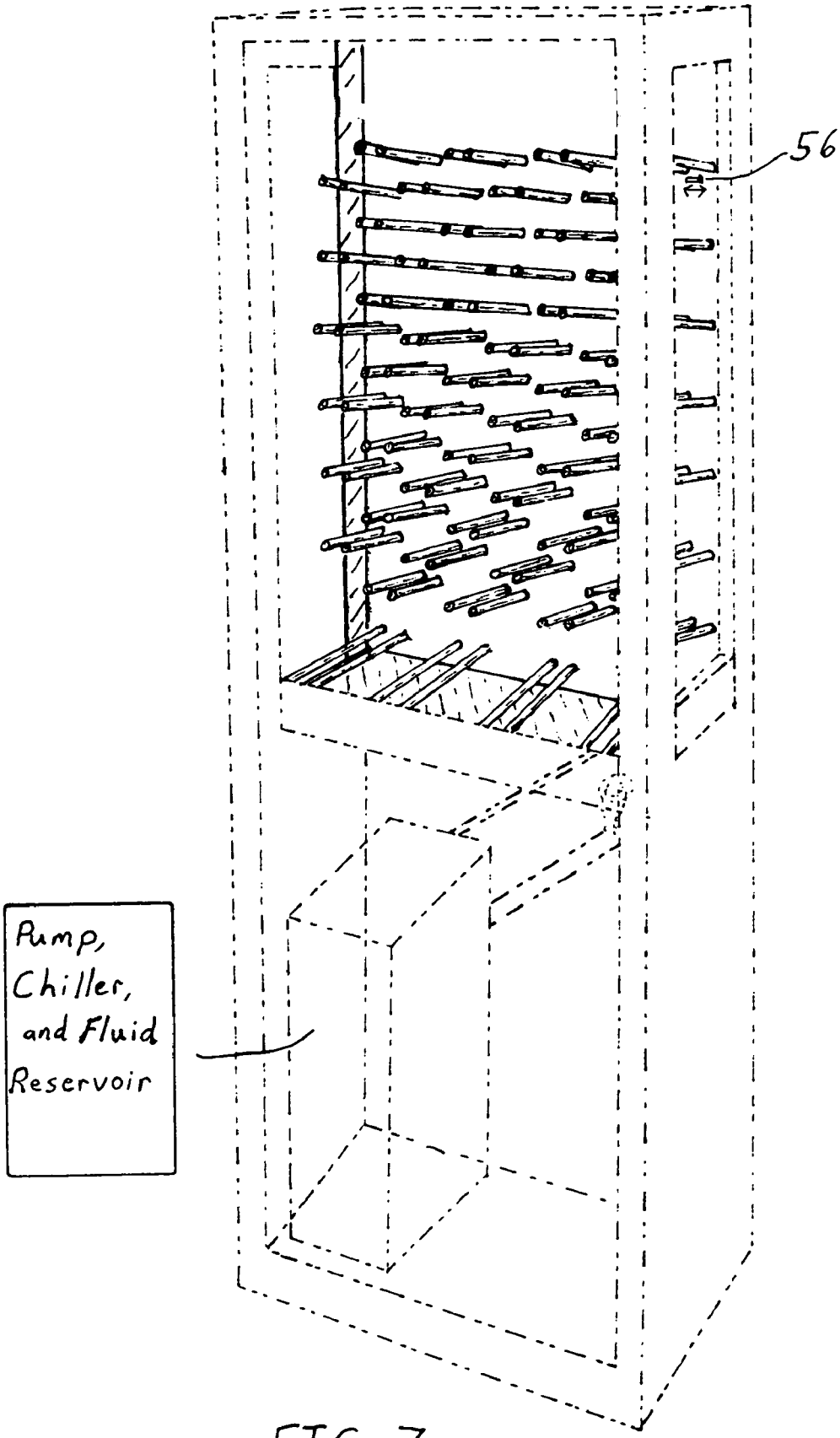
FIG. 7 shows the entire module of the preferred embodiment, without the parts detail, housed within a free-standing floor cabinet unit (optional) with the additional (not part of the module), necessary components for making this embodiment fully functional represented in the drawing as a container and itemized in the text box.

Description—FIGS. 6A and 6B

Final Assembly

Free-flow surface (FFS) 73 is placed upon RSS cover 37 such that all holes align. Then, 18–20 stainless steel pan head screws, evenly dispersed along each inside edge and outside bottom of FFS 73, are used to attach the FFS to RSS 20 and RSS cover 37. All item support members (ISMs) 60, 64, 69 are inserted into their respective holes 28, 30, 32. The holes drilled into the bases of PISM 60 and MISM 68 must align with channels 34 and 36 that terminate in their respective holes 28 and 32. Aluminized silicon caulking is used to seal around the base of each ISM 60, 64, and 69 at the surface of FFS 73.

Description—FIG. 7

This embodiment of the invention is designed and included in a cabinet, portable or built-in but could be joined with multiple units along a wall or walls, or other structure to which the module could attach. Within a cabinet or housed in a remote location, the necessary equipment such as a pump, a fluid reservoir or and a chiller are required to operate the temperature regulating module.

Operation—FIGS. 1–7

The manner of use of the described embodiment of the temperature regulating storage and display module is to attach splitter tubing fitting 50 to an incoming source of temperature-regulated fluid, such as water that is pumped through a thermostatically regulated chiller. By the nature of the design of the module, the fluid is directed through fluid-supply-conduit 48 to reach incoming-fluid manifold slot 24. By applying hand pressure to gated-valve lever 56 to the left or right, the fluid will be directed to either interior SISM to MISM channels 36 of RSS 20 or to the exterior of FFS 37. Lever 56 can be positioned anywhere between the far left or far right to regulate the amount of fluid flowing externally. The internal flow is designed to affect the temperature of the ISMs 60, 64, and 69 by contact and thermal conduction of the fluid across the base of each of the ISMs 60, 64, and 69. Provided that the fluid is supplied in sufficient quantity with sufficient pressure, the net combination of internal and/or external flow will continuously maintain the temperature of ISMs 60, 64, and 69. SISMs 64 and MISMs 69, of this embodiment, are positioned and designed to have bottles of various shapes and diameters placed upon them. The contiguous contact of the combination of thermal conductive materials, including, but not limited to, glass bottles of stored items, copper ISMs 60, 64, and 69 and flowing-fluid, result in the temperature regulation of the contents of the bottles resting upon ISMs 60, 64, and 69. By providing for the routing of the flowing fluid as internal or external to the temperature-regulating module, several aspects are under influence. The amount of fluid that splatters about the perimeter of the invention can be regulated. The sight and sound of the flowing fluid can be altered. The rate of evaporation of the temperature regulating fluid can be influenced.

The fluid is returned to the sink drain assembly by both internal and external flow mechanisms depending upon the position of gated-valve lever 56. The internal flow returns the fluid by way of MISM 68 through MISM outlet port 72. The external flow returns the fluid by way of collection from back copper sheet 74 to base copper sheet 76. The temperature regulating fluid in this embodiment is directed back to a reservoir and pump from sink drain assembly 84.

Figure 8:
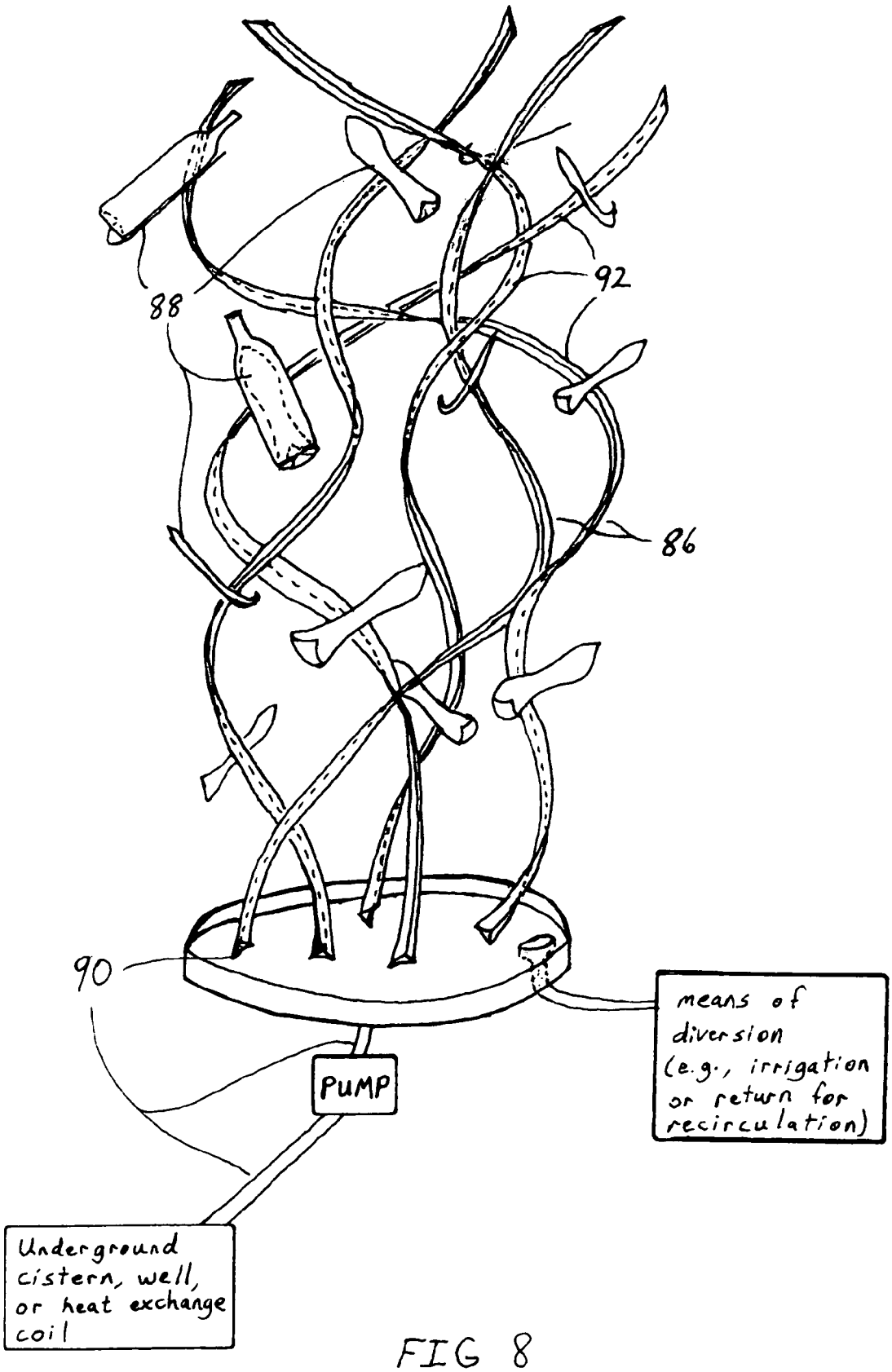
FIG. 8 shows an alternative embodiment of the module.
Figure 9:
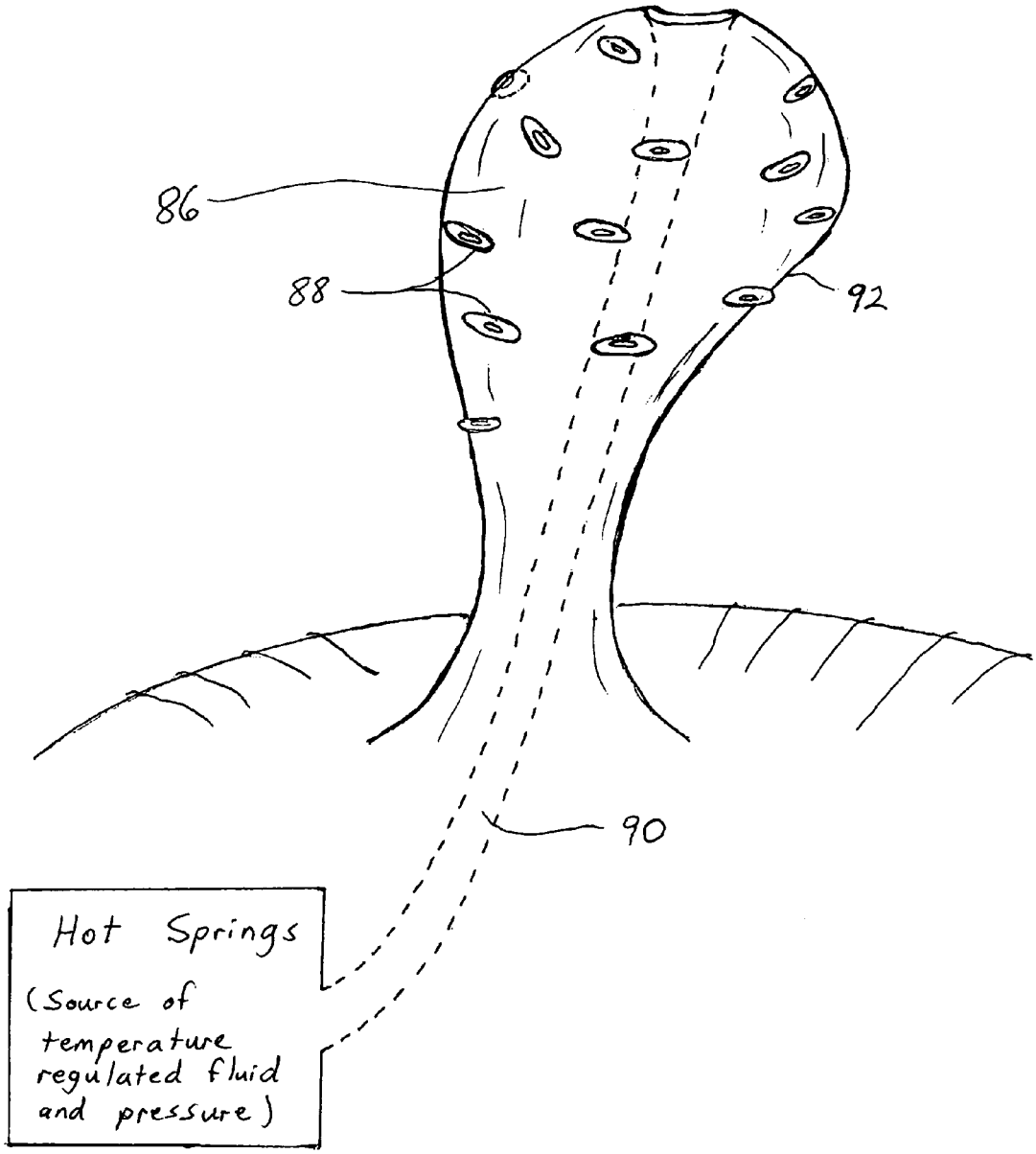
FIG. 9 shows another alternative embodiment of the module.

Description and Operation of Alternative Embodiments—FIGS. 8 and 9

FIGS. 8 and 9 depict alternative embodiments of the claimed module. In FIG. 8, the rigid support structure is a rather free-form array of curving, yet substantially upright ribbons of material such as aluminum, stainless steel, brass, copper, glass or a polymer. The ribbons are cross-linked frequently enough to provide rigidity and strength to handle the weight of heavier items such as full wine bottles. The item support members are welded or brazed or otherwise physically and thermally connected, thus making a substantially direct thermal contact connection with the rigid support structure. The conduit for transfer of the fluid is the interior of the near triangular cross-section ribbon comprising the RSS. The face flow surface is any outside surface of the ribbon. Naturally, the ribbon acting as both the rigid support structure and the fluid-supply-conduit could be designed in an endless number of cross-sections and upright arrangements. The alternative embodiment shown in FIG. 7 utilizes the ambient earth temperature as the means for temperature regulation. A pump appropriately sized to handle the pressure and volume required to supply the adequate quantity of water is selected depending upon those site-specific parameters.

FIG. 9 shows a glass or concrete orb as the RSS with glass or concrete shelves as item support members attached in a manner that will transfer thermal energy to or from them as the fluid, supplied in a conduit through the center of the orb, flows and descends, substantially freely, along the outside surface of the orb contacting the item support members. Here, the thermal hot springs supply both the temperature-regulated fluid as well as the pressure required to transfer the fluid to the substantial height of the RSS. In this embodiment of the invention, some possibilities of perishable items that may be stored and/or displayed are; wrapped candies or pastries, or hot drinks, for clients soaking in the surrounding hot pool. In this embodiment, the hot pool is the diversion for the fluid after it has run its course for the temperature-regulated storage and/or display module.

CONCLUSION, RAMIFICATIONS, AND SCOPE OF INVENTION

Thus the reader will see that the temperature-regulated storage and/or display module of the invention successfully combines many attributes that work in concert with one another to meet many simultaneous needs and provide a model for a wealth of creative embodiments to carry out the more technical functions. There is not found an equivalent in the public domain that can meet the high demands of the market for high-impact, titillating, aesthetic storage and display of perishable items that can simultaneously meet the technical demands for creating a favorable environment for the proper maintenance of the qualities for which these perishable goods are known and desired. The competitive nature of the grand marketplace in which we operate, coupled with the monetary value associated with the goods and related services demand that the systems of storage and presentation keep pace with the quality of the perishable products themselves. The variety and quality of the embodiments that arise from the claims of this invention are an exemplary step in that direction.

While the above descriptions contain much specificity, this should not be construed as limitations on the scope of the invention. Though significant alternative embodiments have been presented as examples in the previous section, these too are not to be construed as definitions of the invention rather as exemplifications of preferred and alternative embodiments. With the employment of more artistic designers than the inventor and the use of materials yet to be considered, the variations of the invention itself are legion.

Accordingly, with due respect to the legal process(es) to which this document will be subjected, I duly remind the readers hereof that the scope of the invention be determined by the appended claims and their legal equivalents rather than by the embodiments illustrated.

I claim:

1. A storage and/or display module wherein the improvement is a structure design for utilizing temperature-regulated, surface-flowing fluid for maintaining the temperature of held perishable items comprising:

(a) a rigid support structure, and (b) a plurality of item support members with substantial capability for thermal conduction, held in position by said rigid support structure, and (c) a means for supplying temperature-regulated fluid to the substantial height of said rigid support structure, and (d) a free-flow surface over which said fluid can descend in a manner that is visible and potentially audible to a person facing said rigid support structure, and (e) a means for direct thermal conductive contact between said fluid and said item support members, and (f) a means for directing said fluid for recirculation or other diversion, whereby the process of regulating the temperature of stored and displayed items simultaneously provides the visual aesthetic qualities of said fluid-in-motion interacting with light and the potential audio aesthetics resulting from the impact of the fluid against structural members during a modified falling descent.

2. The storage and/or display module of claim 1 wherein there is a means for an alternative internal route for the flow of said temperature-regulated fluid to maintain said direct thermal conductive contact or indirect thermal conductive contact between said fluid and said item support members.

3. The rack module of claim 1 wherein said rigid support structure is a polymer into which various milled openings and channels are imparted to direct the pathway of said fluid.

4. The rigid support structure of claim 2 wherein a sliding gated-valve is installed into a cut groove for diverting said fluid to alternate channels.

5. The rigid support structure of claim 2 wherein said item support members are rods or tubes of metal, friction fit into holes within said rigid support structure.

6. The rigid support structure of claim 2 wherein said item support members are tubes of metal with rounded glass affixed to the protruding ends of said tubes of metal.

7. The rack module of claim 1 wherein said item support members are held exclusively by said rigid support structure at the base of said item support members and the base of said item support members are positioned at each intersection of line segments that form a honey-comb network of hexagonal shapes, equidistant on each opposing side of each hexagon.

8. The item support members of claim 7 wherein said item support members are held in an oblique angle of between 3° and 30° with respect to the horizontal.

9. A method of regulating the temperature of stored and/or displayed items while naturally producing the visual and potential audio aesthetic qualities of ambient exposed, flowing fluid, comprising:

(a) providing a rigid structural support for:

(1) supporting a plurality of item support members for holding said items and, (2) housing or supporting a fluid-supply-conduit for elevating said fluid and, (3) lending support to a free-flow surface over which said fluid can flow (b) providing a supply of temperature-regulated fluid, (c) providing a source of pressure to elevate said fluid to sufficient height to allow for a modified free-falling descent of said fluid, (d) providing thermal conduction material for said item support members in contact with said items, (e) providing for substantially direct thermal contact of said item support members with said fluid for the transfer of heat between said temperature-regulated fluid and said stored and/or displayed items, (f) providing a surface over which said fluid can flow to produce the visual and potential audio elements including:

(1) reflection, refraction, and diffraction of ambient light from said flowing fluid, and (2) potential natural sounds of said fluid impacting hard surfaces and interacting with the ambient air, (g) providing for the collection and/or diversion of said descending fluid for eventual recirculation or other distribution, whereby said stored and/or displayed items are maintained to a desired and regulated temperature while the process of maintaining this enhanced storage condition simultaneously provides a visual and potential audio aesthetic advantage to the observer in possession of a proclivity for such an ambiance created by said visual and audio features.

10. The method of claim 9 wherein there is additional structural composition for providing a means to substantially internalize the flow of said temperature-regulating fluid, thereby providing control of the amount of said fluid flowing upon said free-flow surface while continuing to provide an adequate supply of said fluid to maintain the desired temperature of said stored and/or displayed items resting upon said item support members.

* * * * *